United States Patent [19]

Herzog

[11] 4,050,282

[45] Sept. 27, 1977

[54] INNER COOLING SYSTEM ON DRAWING DIE DRUMS

[75] Inventor: Günter Herzog, Hemer-Deilinghofen, Germany

[73] Assignee: Ernst Koch & Co., Hemer-Ihmert, Germany

[21] Appl. No.: 745,798

[22] Filed: Nov. 29, 1976

[30] Foreign Application Priority Data

Nov. 27, 1975 Germany ..... 2553215

[51] Int. Cl.[2] ..... B21C 9/00

[52] U.S. Cl. ..... 72/286; 72/289; 72/40

[58] Field of Search ..... 72/286, 289, 40

[56] References Cited

U.S. PATENT DOCUMENTS

| | | | |
|---|---|---|---|
| 2,162,357 | 6/1939 | Pierce | 72/289 |
| 2,262,247 | 11/1941 | Nye | 72/289 |
| 2,723,744 | 11/1955 | Bruestle | 72/289 |
| 3,143,204 | 8/1964 | Bruestle | 72/286 |
| 3,368,382 | 2/1968 | Fleshman | 72/289 |

FOREIGN PATENT DOCUMENTS

| | | | |
|---|---|---|---|
| 794,316 | 4/1958 | United Kingdom | 72/286 |

*Primary Examiner*—Michael J. Keenan
*Attorney, Agent, or Firm*—Martin A. Farber

[57] ABSTRACT

An inner cooling system on drawing die drums, particularly for the working of wires, includes an inner insert extending substantially across the width of the drawing die drum and slightly spaced from the inner jacket wall of the drawing die drum defining a small rotational gap therebetween, the inner insert being stationarily mounted relative to the rotating drawing die drum. A cooling medium - feed conduit is flow-wise in communication with the gap. The inner insert includes axially extending ribs dividing the inner insert into a plurality of individual chambers one behind the other in a peripheral direction, as well as additional ribs extending in the peripheral direction on an upper and lower edge, respectively, closing the individual chambers at the upper and lower edges, all of the ribs being directed on the inner jacket wall of the drawing die drum spaced therefrom by only the small rotational gap.

8 Claims, 2 Drawing Figures

Figure 1:
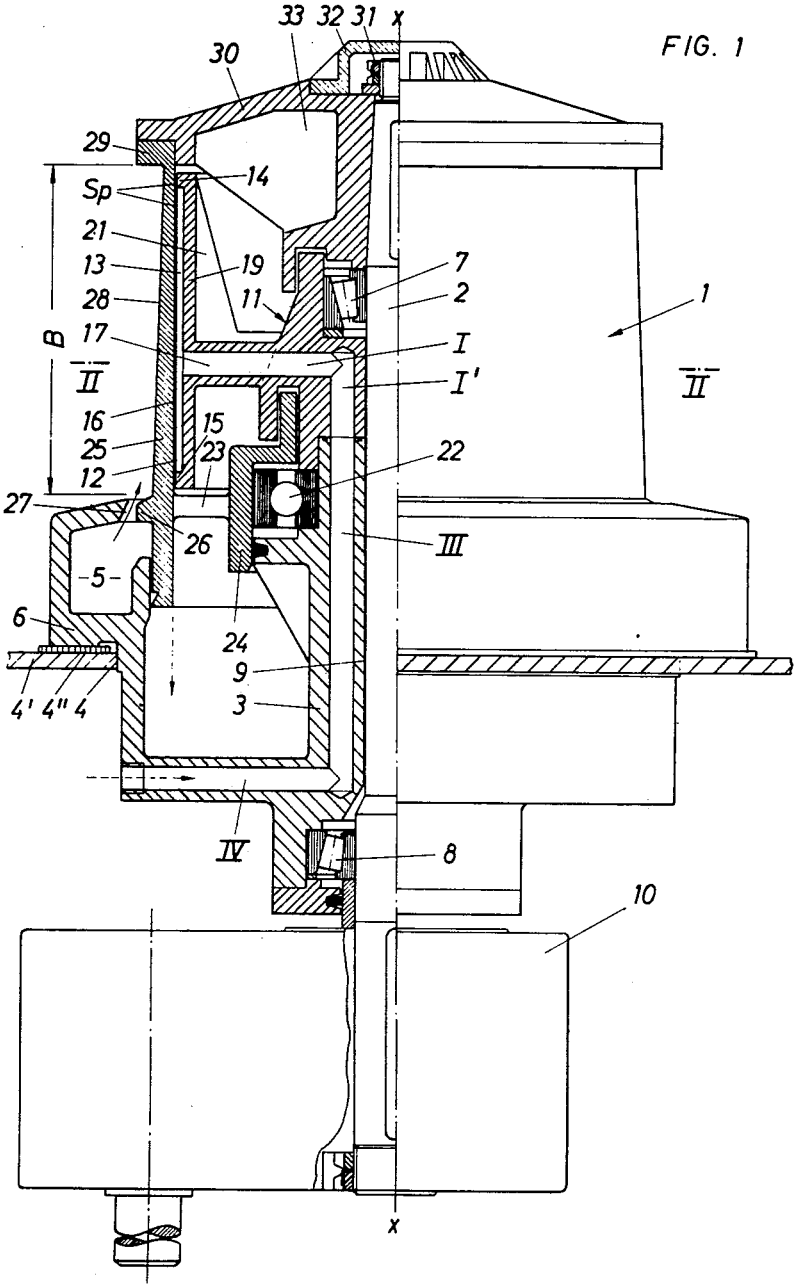

33
32
31
x
30
29
Sp
14
21
13
19
28
11
17
B
II
16
15
25
23
12
27
26
-5-
6
24
9
4'
4"
4
3
IV
8
10
7
2
1
I
I'
II
22
III
x

INNER COOLING SYSTEM ON DRAWING DIE DRUMS

The invention relates to an inner cooling on drawing die drums, particularly for the working of wires, with an inner insert extending substantially over the width of the drawing die drum and stationary relative to the rotating drawing die drum, which leaves a space free, forming a gap relative to the inner jacket wall of the drawing die drum, which gap is connected in flow communication with a feed conduit for cooling medium.

The temperature of the wire during the drawing is raised by working and friction in the drawing die. Corresponding drawing machines are provided with a cooling device for the cooling of the wire. This brings about an inner cooling of the rotating drawing die drum so that by convection to the atmosphere and by a combination of conduction and convection, heat is emitted or given off on this drum. The temperature as known is dependent on many influence magnitudes so that such machines must be provided for a sufficient working or operating breadth. A usual type for the drawing die cooling resides in the use of spray tubes. The water is sprayed on the inner wall of the drawing die drum. Since however the danger exists that the spray nozzles are stopped-up or obstructed for example by suspension particles (frequently water of inferior quality is used), the cooling can cease to take place. Another proposal goes in the direction of a so-called forced circulation cooling, wherein cooling water is fed through a central bore of the drum spindle, which on the drum head passes to a feed conduit for the cooling means leading to the lower drum edge. This is flow-wise connected with an annular slit of the corresponding double walled shaped drawing die drum. The upper edge of the drum has an overflow, by which the warmed up cooling water proceeds to a bottom-sided collecting trough or tank. This solution is relatively expensive. It requires expensive constructive measures to be taken into consideration since rotary connections are needed. Often the annular slit is obstructed by foreign material deposits so that the operability and effectiveness of the cooling indeed stands in question.

Other proposals in order particularly to keep the drum spindle free of conduits reside in damming up or stowing a cooling medium "sea" above or under the drum and to allow the cooling medium to drain through the annular slit of the double walled drawing die drum which is also provided there. The problem of obstructing or clogging up the annular slit is however consequently not solved.

It is an object of the present invention, that is particularly additionally to those objects which may be gathered from the specification and claims, to provide a generic type drawing machine with respect to the inner cooling system in an economically simpler and operationally safe and certain construction form, such that without additional construction parts, foreign material deposits are safely prevented in any case to an extent that would impair the manner of operation of such devices.

As a result of the system in accordance with the present invention, a highly effective reliable inner cooling is achieved on the drawing disc drums of drawing machines, and indeed without the use of additional construction parts. Moreover already existing drawing die drums can cleverly be further developed in the manner that by the particular peripheral formation of the inner insert, scrapers which carry off arising deposits are formed. These constitute axially extending ribs which are arranged one lying behind the other in the peripheral direction. These ribs also together with ribs which extend in the peripheral direction at the upper and lower edge form individual chambers which are supplied with cooling medium. All ribs are aligned or directed complementarily on the inner jacket surface or wall of the drawing die drum. They end however with small play in front of this inner jacket surface. This amounts to less than 0.5 mm, preferably 0.2 mm, so that possible foreign material deposits are permanently carried off by the rotating drawing die drum, and indeed particularly when the drawing die drum takes a generally unavoidable, untrue or non-round course, which occurs as a rule on the basis of loading variations. This leads to fractional or partial approximations or approaches from rib and inner jacket surfaces of the drawing die drum, which in practice still lie under the mentioned values.

Since a continual steady removal occurs, no larger deposits can arise, so that the cooling medium which leaves at the top and bottom through the rotational gap washes the suspension particles away. A particularly uniform and constant cooling occurs by three individual chambers which are arranged angularly symmetrically with respect to one another, of which each extends approximately over 110°, since for the formation of the axial ribs only a smaller angular range is required. The cooling action is yet further increased in the manner that each individual chamber possesses for itself a separated feed conduit for the cooling medium, which beside being arranged in the insert also are arranged in corresponding uniform angular distribution in the stator, the later mounting the drawing die drum spindle. Such a type of feed conduit is no longer dependent upon rotary connections and thus is exceptionally free of service. A further advantageous feature for comparison of the cooling medium- flow-relationship or proportion is that the feed conduits for the cooling medium open in each individual chamber approximately in the center range of each chamber. The cooling medium enters practically centrally in the individual chamber, from which point it is uniformly distributed.

Figure 2:
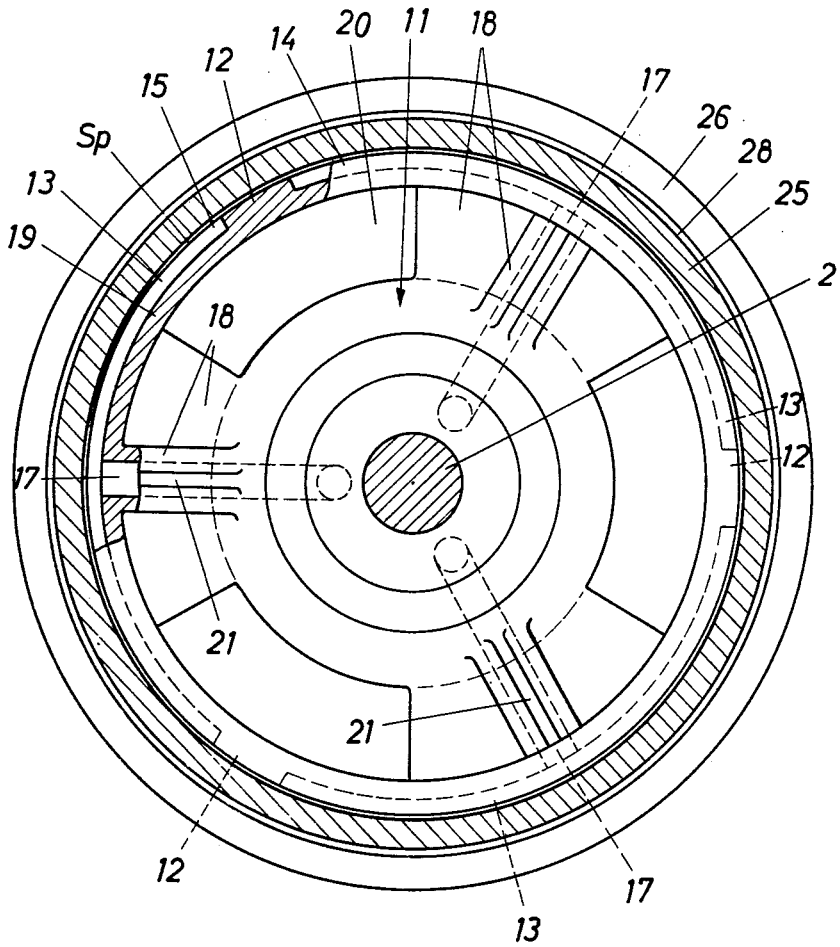

With the above and other objects and advantages in view, the present invention will become more clearly understood in connection with the following detailed description of a preferred embodiment, when considered with the accompanying drawings, of which:

FIG. 1 is a vertical elevational view partly in radial section through the drawing die drum; and FIG. 2 is a section taken along the lines II—II of FIG. 1.

Referring now to the drawings, the drawing die cylinder or drum 1 which forms part of the drawing machine sits on a vertically arranged spindle 2. The latter is mounted in a stator 3. In turn the latter sits in an opening 4 of the cover 4' of a machine support. The stator 3 which is constructed substantially rotationally-symmetric, overlappingly engages with a flange-type edge 6 forming an annular channel 5, the edge 4'' of the opening 4 of the cover 4'.

The spindle 2 is mounted at both ends at centering-acting conical roller bearings 7 and 8. The spindle 2 is set through the central stator bore 9 with relatively large play.

The lower end of the spindle stands in drive connection with a transmission or drive 10.

While the lower lying conical roller bearing 8 sits directly in a collar on the stator, the upper lying roller bearing 7 is accomodated in a likewise stationary inner insert 11 which forms a cooling ring and which completes or complements the stator toward the top. The insert 11 and stator 3 are rigidly connected to each other.

Also the inner insert 11 is shaped rotationally-symmetrically and extends substantially over the width B of the drawing die drum 1. It has individual chambers 13 which are separated from one another by axially extending ribs 12, which chambers 13 are disposed one lying behind the other in the peripheral direction. The chambers 13 are closed at the upper and lower edge of the drum by ribs 14 and 15 extending in the peripheral direction. All together the ribs, 12, 14, and 15 are of equal radial extent and point in the direction of the rotating drawing die drum 1, and indeed leaving blank or empty only a small turning gap Sp of 0.5 mm to 0.2 mm relative to the inner jacket surface 16.

The individual chambers 13 are arranged angularly symmetric. In the present case, the inner insert has three chambers 13, which extend planar-wise substantially over an angular section of approximately 110°.

Each individual chamber is respectively itself connected over a cooling means- supply or feed conduit 17 to an all common cooling medium source. These feed conduits each comprise a bore section I which is aligned radially and perpendicularly to the spindle axis *x—x.* The latter is connected to a bore section I' of the inner insert 11, which bore section I' extends in the axial direction of the spindle, that is parallel axially thereto. A corresponding bore section III lying congruently thereto forms the cooling medium-feed conduit in the stator 3. The bottom sided connection brings after that a bore section IV, which again extends radially as well as perpendicularly to the spindle axis *x—x.* All bore sections of a conduit 17 lie in the same angular plane. At the lower peripheral bore ends there sit connection fittings which are not illustrated more closely. These lead to an annular conduit via tube sections, which annular conduit stands in connection with a cooling medium source.

The feed conduit 17 for the cooling medium opens substantially in the center range of each angle chamber 13. The bore sections I forming part of these feed conduits run in star-shaped arranged bridges 18. The latter form spoke-like carriers of the peripheral wall 19 of the inner insert 11. The connection zone there extends over about 60°. The free zone 20 following in the peripheral direction forms communicating flow-through cross sections for the cooling medium which leaves via the upper rotational gap *Sp.*

The upper angular space between the peripheral wall 19 and the bridge 18 is additionally reinforced by means of radial ribs 21.

The axially extending ribs 12 are arranged on the peripheral wall 19 offset between the bridges 18. These ribs 12 sit consequently on a freely tensioned arch or curved section of the annular-shaped inner insert.

The axially extending ribs 12 form effective scraping or stripping ledges with respect to possible foreign material deposits on the inner jacket surface 16 of the rotating drawing die drum. The selected small spacing between this inner jacket surface 16 and the rib comb leads to a constant or continuous carrying away of the foreign material deposits. A momentary larger approximation of these axial extending ribs 12 to be attributed to the load variations, was found to lead indeed to a removal also of the slightest deposit sediments, and this although the drawing die drum 1 is mounted with the greatest possible precision. Thereby a self-sharpening of the stripping edges also occurs. In addition to the mounting on the spindle head by use of the present conical roller bearing 7, an additional mounting of the inner drum edge on the stator 3 is brought about by the use of a ball bearing 22. For this purpose the drum edge there continues over spoke-type radial ribs 23 in the drum hub 24.

The drum wall 25 forms a bead-like collar 26 at the level of these radial ribs 23. The stator flange 6 ends in front of this collar leaving a space forming an annular gap 27, the stator flange 6 forming the annular chamber 5. Cooling air is fed through this annular chamber 5 which maintains its direction of flow by means of the annular gap 27, the latter pointing to the angular surface 28 of the drawing die drum.

The upper drawing die drum edge which forms a securing flange 29 is suspended on a disc head 30 which is wedged or keyed with the conical spindle end and for that purpose is interconnected with this edge. The holding means between the head 30 and the spindle 2 in the form of secured or protected counter or lock nuts 31 are covered by means of a protective cap 32. Also this head 30 is stabilized by means of radial ribs 33.

The cooling medium which leaves the upper and lower ends of the rotational gap Sp flows off on the inner jacket surface and through the free zones 20 of the inner insert 11 and stator 3, respectively.

While there has been disclosed one embodiment of the invention, this embodiment is given by example only and not in a limiting sense.

I claim:

1. Inner cooling system on drawing die drums, particularly for the working of wires, comprising a rotating drawing die drum having an inner jacket wall, an inner insert extending substantially across the width of said drawing die drum and slightly spaced from said inner jacket wall of said drawing die drum defining a small rotational gap therebetween, said inner insert being stationarily mounted relative to said rotating drawing die drum, said inner insert including vertical axially extending ribs dividing said inner insert into a plurality of individual chambers lying angularly spaced one behind the other in a peripheral direction by said axially extending ribs, said inner insert including circumferential peripheral ribs extending in a peripheral direction on an upper and lower edge, respectively, closing said individual chambers at said upper and lower edges, respectively, all of said ribs having free ends being adjusted to said inner jacket wall of said drawing die drum spaced opposite therefrom defining said small rotational gap therebetween, said free ends of said axially extending ribs constituting scrapers extending along the axial length of said inner jacket wall and scraping the latter clean during rotation of said drawing die drum, feed conduit means for a continuous refreshing cooling medium flow-wise communicating with said individual chambers for supplying cooling medium thereto.

2. The inner cooling system as set forth in claim 1, wherein said axially extending ribs are angularly symmetrically disposed on said inner insert forming therebetween three of said individual chambers likewise angularly symmetrically arranged with respect to each other, each of said individual chambers extending approximately over 110°.

3. The inner cooling system as set forth in claim 1, wherein said feed conduit means comprises a separated feed conduit for the cooling medium for each of said individual chambers and in communication therewith, respectively, formed in said insert member, a drawing die spindle, a stator means for mounting said drawing die spindle therein, said insert is connected to said stator, said separated feed conduits being arranged in uniform angular distribution connected directly in said inner insert.

4. The inner cooling system as set forth in claim 1, wherein said separated feed conduits open in each of said individual chambers substantially in a center range of each of said individual chambers, respectively.

5. The inner cooling system as set forth in claim 1, wherein said inner insert includes a peripheral wall, and said ribs extend radially outwardly therefrom towards said inner jacket wall of said drawing die drum.

6. The inner cooling system as set forth in claim 5, wherein said peripheral wall of said inner insert forms a back thereof defining a free zone in communication with said rotational gap through which the cooling medium flows off therefrom.

7. The inner cooling system as set forth in claim 1, wherein said gap being between 0.5 mm to 0.2 mm between said free ends of said ribs and said inner jacket wall of said drawing die drum.

8. The inner cooling system as set forth in claim 4, wherein, said inner insert includes a peripheral wall, said separated feed conduits constitute spoke-like carriers of said peripheral wall.

* * * * *